United States Patent [19]

Haddad

[11] 4,031,751

[45] June 28, 1977

[54] CLOSED SYSTEM FOR TESTING THE CONDITION OF WELL BORE FORMATIONS

[75] Inventor: Richard Y. Haddad, Pittsburgh, Pa.

[73] Assignee: Haddad and Brooks, Inc., Upper St. Clair, Pa.

[22] Filed: Sept. 22, 1976

[21] Appl. No.: 725,635

[52] U.S. Cl. ..... 73/155

[51] Int. Cl.[2] ..... E21B 47/00

[58] Field of Search ..... 73/155, 40.5 R, 153, 73/19, 151; 166/250

[56] References Cited

UNITED STATES PATENTS

| | | | |
|---|---|---|---|
| 3,031,571 | 4/1962 | Fearon | 73/153 X |
| 3,726,136 | 4/1973 | McKean et al. | 73/155 |

*Primary Examiner*—Jerry W. Myracle
*Attorney, Agent, or Firm*—Stanley J. Price; John M. Adams

[57] ABSTRACT

In testing the condition of well bore formations as to fluid flow into and out of the surrounding formations and gas emission therefrom prior to cementing a production casing in the well bore, a testing fluid of a preselected density, such as a salt water solution, is pumped from a source through a treating conduit into the production casing positioned in the well bore. The testing fluid is circulated down the production casing and up the annulus between the production casing and well bore formations displacing drilling fluid and other materials therefrom. For an empty well bore the production casing and annulus are filled with the testing fluid. Samples of the fluids are directed periodically to a gas detector to test for the presence of gas emitted from the formations surrounding the well bore. Once the well bore is flushed clean, the testing fluid is conveyed through a closed circulating system of conduits to a storage vessel. The storage vessel is connected by a suction conduit to the pump that conveys the fluid from the source to the well bore. After a preselected volume of fluid is established in the storage vessel and the testing fluid is circulating through the well bore, flow from the source is terminated and the fluid level in the storage vessel is monitored for a loss of fluid into the formations surrounding the well bore or flow of fluid from the formations into the well bore.

11 Claims, 1 Drawing Figure

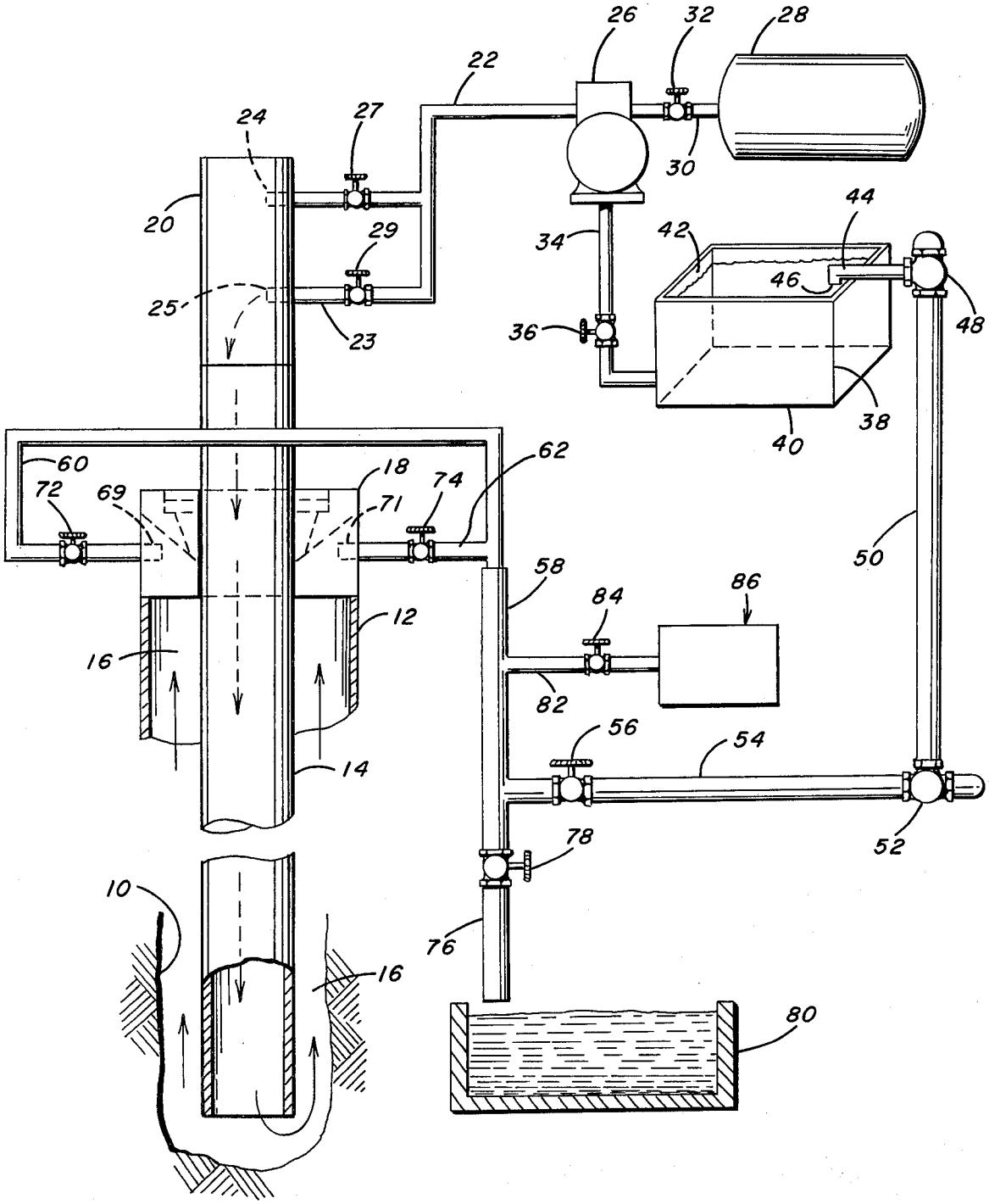
26
32
28
22
24
27
30
20
29
34
42
44
46
25
23
36
48
38
40
60
62
18
74
72
69
71
50
58
86
84
12
16
82
56
54
14
52
78
10
76
16
80

CLOSED SYSTEM FOR TESTING THE CONDITION OF WELL BORE FORMATIONS

BACKGROUND OF THE INVENTION

1. Field of the Invention

This invention relates to a method for testing the condition of well bore formations for cementing a production casing to the wall of the well bore and more particularly to a method for indicating the flow of fluid into or out of the formations surrounding the well bore and the emission of gas from the surrounding formations into the well bore.

2. Description of the Prior Art

In conventional drilling operations in prospecting for minerals of a gaseous or liquid nature, well bores are drilled. After the well bore has been drilled and the decision made to complete the well for production of the desired mineral, a production casing for subsequent completion and production procedures is installed. It is conventional practice to secure the production casing in the well bore by means of cement.

The cementing operation is carried out by pumping a cement slurry down the inside of the production casing to the bottom of the casing and therefrom up around the casing into the annulus between the casing and the wall of the well bore. In this manner the production casing is cemented in the well bore along all or selected portions of the length of the production casing. For subsequent completion and production operations, it is important that a good bond exist between the production casing and the cement, as well as between the cement and the formations comprising the wall of the well bore after the cement has set. However, problems are encountered in obtaining the required bond when the cement slurry and/or other fluids used in the cementing procedure are lost from the annulus between the production casing and the wall of the well bore by the flow thereof into permeable formations, or fractures, cavities or fissures in formations surrounding the well bore. This loss or in certain instances, flow of fluid from formations into the well bore usually results in a poor cement job, as for example, incomplete cementing, movement and weakening of setting cement, unsatisfactory cement bond to the casing and/or formations in the well bore. In addition, the cementing of the production casing is adversely affected by the emission of gas from the well bore formations causing voids or channels in the cement, unsatisfactory bond and unstable conditions in and above the setting cement. It is essential, therefore, that the condition of the well bore formations be known by testing before cementing the production casing so that remedial action can be taken if adverse conditions exist.

Though monitoring during drilling operations for a loss of drilling fluid to the well bore formation or the intrusion of formation fluid into the well bore is disclosed by U.S. Pat. No. 3,857,281, the method and operation disclosed relates to maintaining the requisite volume of drilling fluid within the well bore to insure that a dangerous condition, such as a blowout condition, does not arise during times when the drill string is either being run into or removed from the well bore. This method and apparatus does not indicate the condition of the well bore formations as to the emission of gas from the well bore formations or concern itself with borehole conditions in the installation of production casing.

A system for automatically filling well bores with drilling fluid during drilling operations is disclosed in U.S. Pat. No. 3,833,076. There a volume of drilling fluid entering the well bore is continually monitored. The apparatus is operable to signal a loss of the drilling fluid in excess of a predetermined threshold. The problem of maintaining fluid level in the well bore becomes particularly acute when the drill string is withdrawn from the hole and there is a lowering of the fluid level within the hole caused by the absence of the drill string body which when removed displaces a considerable amount of fluid. Also, it is noted that the fluid level in the well bore may be lowered by filtration of a portion of the liquid into the porous formations surrounding the well bore. However, the above system is confined to maintaining the drilling fluid level within a well bore and automatically pumping into the well bore the amount necessary to maintain a predetermined amount of drilling mud therein.

Similarly, U.S. Pat. No. 3,614,761 discloses a method and apparatus for monitoring potential blowouts or lost circulation in a well. The apparatus monitors for potential blowouts by sensing devices on the drilling fluid pump and the well bore return pipe to the drilling fluid pit. A signal is generated indicating flow of the drilling fluid out of the well bore. U.S. Pat. No. 3,638,485 discloses monitoring the drilling fluid level to warn of an intrusion of formation fluids. U.S. Pat. No. 2,966,059 discloses fluid monitoring means in a drilling mud system to indicate gain or loss of fluid to or from the formation. U.S. Pat. Nos. 3,550,445, 3,602,322 and 3,726,136 disclose monitoring and control apparatus for maintaining a preselected volume of drilling fluid in the well bore.

While it has been suggested to monitor the drilling fluid level in a well bore to assure that blowout conditions do not occur, the prior art systems are not directed to testing, the condition of well bore formations, the loss of fluid into or flow from the formations surrounding the well bore and the emission of gas from the formations surrounding the well bore in preparation for cementing production casing in the well bore. Much of present day drilling is performed with drilling fluids which do not condition the well bore, well bore wall or formations surrounding the well bore properly for successful cementing of production casing. In addition, much of present day drilling is performed with air or gas as a drilling medium making impossible the determination of the condition of the well bore formations relative to the behavior of the liquids which will be used in cementing the production casing. Therefore, there is a need to provide method and apparatus for determining that the condition of the well bore formations is satisfactory in preparing the well bore for cementing the production casing in the well bore, particularly when such determination has been impossible or inconclusive prior to running the production casing into the well bore.

SUMMARY OF THE INVENTION

In accordance with the present invention, there is provided a method for testing the condition of well bore formations prior to the cementing of the production casing therein that includes the step of introducing a testing fluid having a preselected density from a source into the well bore. The testing fluid is circulated through the well bore, and drilling fluid and other materials present in the well bore are displaced therefrom by the circulating fluid. The testing fluid, displacing the drilling fluid ahead of it, and other materials are conveyed from the well bore, and samples of the fluid flow from the well bore are tested for the presence of gas emitted from the formations surrounding the well bore.

The testing fluid is directed from the well bore to a storage vessel. With a known volume of the fluid present in the storage vessel, testing fluid is circulated therefrom back to the well bore and returned to the storage vessel in a closed circulating system. The volume of testing fluid in the storage vessel is continuously monitored to determine a loss of fluid into the formations surrounding the well bore or flow of fluid therefrom and thereby indicate the effect of the well bore, well bore wall and surrounding formations on the cementing procedure to follow.

The testing fluid is supplied from a tank by a pump that is connected by a treating conduit to the head of the production casing. The pump is also connected by a conduit and valve to the storage vessel. The production casing is concentrically positioned within a surface casing that extends to the top of the well bore. An annulus is formed between the outer surface of the production casing and the inner surface of the surface casing. Below the bottom end of the surface casing an annulus is also formed between the outer surface of the production casing and the wall of the well bore. The open, upper end of the surface casing surrounding the production casing is sealed by a casing head.

The testing fluid is circulated downward through the production casing and upward through the annulus to the casing head and flows out of the well bore through ports in the head of the surface casing. From the casing head the fluid is conveyed through a manifold to a common conduit that is connected by a sampling conduit to a gas detector. The gas detector is operable to indicate the presence of gas in the sample and thereby establish the nature of the formations surrounding the well bore as to the emission of gas therefrom. The fluid is conveyed from the well bore to a pit until the well bore has been flushed clean of drilling fluid and other materials. When a clean stream is established to the pit, flow thereto is terminated and is directed through a circulating system comprising a series of conduits to the storage vessel. Once a selected volume of fluid has been established in the storage vessel, circulation of the fluid in the closed system from the storage vessel through the well bore and back to the storage vessel is maintained. Flow from the source is terminated, and the pump is operated to maintain the fluid flow through the closed system.

The fluid level within the storage vessel is continuously monitored to indicate a change in the volume of fluid within the storage vessel. A decrease in the fluid level indicates that the fluid is being lost into the formations surrounding the well bore; whereas, an increase indicates that fluid is flowing from formations into the well bore. As the fluid level is monitored, sampling of the fluid for presence of gas is continued to determine if gas is being emitted from the formations surrounding the well bore. Thus, with the present invention it is possible to determine the condition of the well bore formations for cementing of the production casing. Once these conditions have been determined, corrective action can be taken, if necessary, to prepare the well bore prior to cementing the production casing in place.

Accordingly, the principle object of the present invention is to provide a method for indicating a loss of fluid to well bore formations or flow of fluid therefrom and the emission of gas from the formations into the well bore prior to cementing a production casing in the well bore.

Another object of the present invention is to provide a method to clean the wall of the well bore to prepare the well bore for cementing of the production casing and at the same time maintain the hydrostatic pressure provided by the drilling mud to oppose the bottom pressure of the formation and prevent a blowout condition for occurring during the time in which the well bore formations are being tested and prepared for cementing of the production casing.

These and other objects of the present invention will be more completely described and disclosed in the following specification, the accompanying drawing and the appended claims.

BRIEF DESCRIPTION OF THE DRAWINGS

The drawing is a schematic illustration of the method and apparatus for testing the condition of well bore formations before the cementing of a production casing therein.

DESCRIPTION OF THE PREFERRED EMBODIMENT

Referring to the drawing there is illustrated a well bore adapted for use in prospecting for minerals, such as gaseous or liquid minerals. During the drilling operation in forming the well bore 10, the well bore is lined with a surface casing 12 that extends to ground level and may extend into the well bore a distance of, for example, 20 percent of the depth of the well bore. Concentrically positioned within the surface casing 12 is a production casing 14 having a smaller diameter than the surface casing. Thus, with this arrangement an annulus 16 is formed between the wall of the well bore and the production casing 14. The production casing is open to the annulus at the bottom. Adjacent the surface, the annulus 16 is formed between the surface casing 12 and the production casing 14. The open upper end portion of the surface casing 12 is sealed by a casing head 18 that is secured to the surface casing 12 and surrounds in fluid-tight relation the production casing 14. Similarly, the upper end portion of the production casing 14 is closed by a head 20.

When the well bore is being prepared for operation and after it has been prepared for operation and the minerals are to be extracted, the production casing 14 serves as the conduit through which treating fluids are introduced and minerals are extracted from the well bore. Therefore, to securely position the production casing 14 within the well bore 10, the production casing 14 is bonded to the formations comprising the wall of the well bore along selected portions of its length by cementing.

Before cementing it is necessary to test the condition of the well bore, the condition of the wall of the well bore formed by rock formations and the condition of the formations surrounding the well bore, herein collectively called the condition of the well bore formations. To facilitate testing of the well bore formations as to absorbing the fluids introduced into the annulus 16 or giving up fluids to the annulus and the emission of gas, such as natural gas, from the formations surrounding the well bore into liquids and slurries used in cementing, a suitable testing fluid is introduced into the well bore 10 through the production casing 14 by a treating conduit 22. The treating conduit 22 has branches 21 and 23 that communicate with ports 24 and 25 in the cement head 20 and into the production casing 14. A pair of valves 27 and 29 are provided in the conduit branches 21 and 23 for controlling the flow of the treating fluid from a pump 26 into the production casing 14. The pump 26 conducts the testing fluid from a source, such as tank 28. The tank 28 is connected to the pump 26 by a suction conduit 30 having a valve 32 positioned in the conduit 30 for controlling the flow of the testing fluid from the tank 28 to the pump 26. The pump 26 is also connected by a suction conduit 34 having a valve 36 to a fluid storage tank or vessel 38.

The testing fluid contained in the tank 28 may be any fluid suitable for the particular well bore formations being tested, having sufficient density to maintain the required hydrostatic head to prevent a blowout condition when the well bore is flushed clean in preparing the well bore for cementing of the production casing 14. Salt water or various types of commercially available fluid systems may be used.

The storage vessel 38 has a sealed bottom portion 40 and an opening (not shown) for receiving the suction conduit 34. The vessel 38 has an open upper end porton 42. A pipe 44 extends above the storage vessel upper portion 42 and includes an outlet 46 through which the testing fluid, as will later be explained in greater detail, is conducted into the storage vessel 38 from the pipe 44. The pipe 44 is connected by a suitable connection 48 to a conduit 50 that is, in turn, connected by connection 52 to conduit 54 that includes a valve 56 for controlling fluid flow into conduit 54 from a conduit 58 that communicates with the annulus 16 within the well bore 10 between the production casing 14 and the surface casing 12. The pipe 44 and conduits 50 and 54 together with connections and valves associated therewith serve as a circulating system for conducting the testing fluid from the well bore into the storage vessel 38.

The conduit 58 includes branches or manifold 60 and 62 that extend from the casing head 18 of the surface casing 12. The casing head 18 includes ports 69 and 71 that are open to the well bore. The manifolds 60 and 62 are provided with suitable valves 72 and 74 respectively. With this arrangement fluid flows from the well bore through the ports 69 and 71 of the casing head 18 into the manifolds 60 and 62.

Flow from the mainfolds 60 and 62 is directed into conduit 58 which is connected to a return conduit 76 by a suitable valve 78. The return conduit 76 conducts returning fluid from the well bore to fluid pit 80. The conduit 58 is also connected to a sampling conduit 82 having a valve 84 for controlling flow of a sample of the fluid in the conduit 58 to a gas detector generally designated by the numeral 86. The gas detector 86 is of the conventional type known in the art for detecting the presence of the gas, such as methane, in a fluid to be tested.

In operation, the valve 56 controlling the flow of fluid from conduit 58 to conduits 54 and 50 is closed, as well as valve 84 in sampling conduit 82 leading to the gas detector 86. The valve 78 for controlling the return flow in conduit 76 to the pit 80 is opened, and the valves 72 and 74 of manifolds 60 and 62 are opened. Thereafter, the testing fluid is introduced into the well bore from the tank 28 by operation of the pump 26 with the valve 32 in an open position. Pump 26 draws the testing fluid, which as stated hereinabove may a salt water solution or other suitable liquid, from the tank 28 through the conduit 30 and the pump 26 into the treating conduit 22. The testing fluid enters the production casing 14 through the conduit 22. The testing fluid enters the production casing 14 through the conduit branch 23 and the open valve 29 into port 25 of the production casing head 20. Valve 27 is closed. The testng fluid enters the production casing 14 and flows through to the annulus 16 and through the annulus 16 into the ports 69 and 71 of the casing head 18. From the casing head 18 the testing fluid, displacing the drilling fluid ahead of it, flows through manifold 60 and 62 to conduit 58. When valve 84 is in an open position, a sample of the testing fluid and/or drilling fluid is extracted from conduit 58 and is conveyed to the gas detector 86. If gas has been emitted from a porous formation surrounding the well bore, gas will be present in the sample and, accordingly, a positive reading of the gas detector will indicate the presence of gas in the fluid.

From the conduit 58, the testing fluid, displacing the drilling fluid ahead of it, passes through the valve 78 into the return conduit 76 and the pip 80. Circulation of the fluid to the pit 80 continues until a clean flow of testing fluid from conduit 76 is established. With the drilling fluid flushed from the well bore, the testing fluid maintains the necessary hydrostatic head to oppose the bottom hole pressure. Once the well bore has been flushed clean, as indicated by the fluid flow to the pit 80, the valve 56 is opened and the valve 78 is closed to permit flow through conduits 54 and 50. Thus, the fluid flow is now directed from the well bore through the closed circulating system to the storage vessel 38.

The testing fluid is circulated from the tank 28 through the pump 26 to the well bore 10 and therefrom to the storage vessel 38 and back through the well bore until a preselected fluid volume is established within the storage vessel 38. With a sufficient volume of testing fluid circulating through the well bore and a desired fluid level present in the storage vessel 38, the valve 32 connecting the tank 28 with pump 26 is closed. The valve 36 is maintained in an open position and testing fluid is withdrawn from vessel 38 by pump 26 and is directed into the well bore while testing fluid is circulated through the well bore back to the vessei 38. With this arrangement a closed system is established in which a known volume of testing fluid is being circulated through the well bore.

The fluid level in the storage tank is continually monitored to detect a change in the volume of fluid in the storage vessel 38. Accordingly, a decrease in the volume of fluid indicates that in the closed system fluid is being lost into a formation or formations surrounding the well bore. On the other hand, in certain instance, flow of fluid from the formation surrounding the well bore into the well bore is possible, and would result in an increase in volume of fluid. If the fluid level in storage vessel 38 remains constant, fluid is not being lost into or gained from the well bore formations. This then would indicate that the well bore is sufficiently sealed to prevent the cement slurry or other liquids used in the cementing process from being absorbed into the rock formations surrounding the well bore or altered by flow of fluid from formations surrounding the well bore. If the fluid level in the storage level 38 drops during the period in which the fluid is being circulated, the condition of the formation surrounding the well bore indicates that cement slurry or other liquids used in the cementing process directed into the annulus 16 between the production casing 14 and the wall of the well bore will flow into the fractures, cavities or fissures in formations surrounding the well bore. Accordingly, remedial action, known in the art, must be taken. Similarly, if the gas detector 86 monitors, after a preselected time, the presence of gas in a sample of the testing fluid, the appropriate action must be taken to terminate the gas emission.

It will be apparent that the practice of the present invention provides a solution to the problem of determining the condition of the well bore formations for cementing the production casing in the well bore, particularly in those instances where such a determination has previously been impossible to make with the necessary degree of certainty. With the present invention it is now possible to determine whether the well bore formations will permit cementing of the production casing without encountering a loss of cement slurry or other liquids used in the cementing process to the well bore formations and intrusion of gas into the cement within the well bore. Thus, with the method of the present invention, it is possible to evaluate the condition of well bore formations to assure that the production casing can be securely bonded to the wall of the well bore by cementing.

Although the foregoing describes the process and apparatus for testing the condition of well bore formations for cementing a production casing in the well bore, it should be understood that the process and apparatus may also be used with equal facility in testing the condition of well bore formations for cementing surface casing or any intermediate casing string. Surface casing is the first string of casing run in the well bore and the intermediate casing string is any string run during the drilling of a well prior to cementing production casing.

According to the provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. Method for testing the condition of well bore formations in a closed system for cementing a casing in the well bore comprising, introducing a testing fluid having a preselected density from a source into the well bore, circulating said fluid through the well bore, displacing drilling fluid and other materials from the well bore by the flow of said testing fluid therethrough, conveying said testing fluid and the drilling fluid and other materials from the well bore, and monitoring samples of the flow from the well bore for the presence of gas emitted from formations surrounding the well bore.

2. Method for testing the condition of well bore formations as set forth in claim 1 which includes, directing the fluid flow from the well bore to a pit, and maintaining the fluid flow to said pit until the flow thereto is free of drilling fluid and other materials.

3. Method for testing the condition of well bore formations as set forth in claim 1 which includes, supplying said testing fluid from said source connected in fluid communication with the well bore, circulating said testing fluid through the well bore, directing said testing fluid from the well bore to a storage vessel, and conveying said testing fluid from said storage vessel into the flow of said testing fluid from said source to the well bore.

4. Method for testing the condition of well bore formations as set forth in claim 3 which includes, terminating flow from said source into the well bore after a preselected volume of said testing fluid is established in said storage vessel and circulating through the well bore, conveying said testing fluid from said storage vessel to the well bore and back to said storage vessel to establish a closed circulating system, and monitoring the volume of said testing fluid in said storage vessel as said testing fluid circulates through the well bore for a change in the volume of said testing fluid in the well bore by the flow of fluid into and out of the formations surrounding the well bore.

5. Method for testing the condition of well bore formations in a closed system as set forth in claim 1 which includes, introducing said testing fluid consisting of a salt water solution from said source into the well bore, flushing the drilling mud and other materials from the well bore by the circulation of said salt water solution through the well bore, and maintaining a hydrostatic head within the well bore by said testing fluid greater than the bottom pressure of the well bore to prevent a blowout condition during the testing of the well bore formations.

6. Method for testing the condition of well bore formations in a closed system for cementing a casing in the well bore comprising, introducing a testing fluid having a preselected density from a source into the well bore, circulating said fluid through the well bore, displacing drilling fluid and other materials from the well bore by the flow of testing fluid therethrough, conveying said testing fluid and the drilling fluid and other materials from the well bore, maintaining a circulating flow of a known volume of said testing fluid into and out of the well, and monitoring the flow of said testing fluid through the well bore to determine a change in the volume of said testing fluid therein by the flow of fluid into and out of the formations surrounding the well bore.

7. Method for testing the condition of well bore formations as set forth in claim 6 which includes, directing the fluid flow from the well bore to a pit, and maintaining the fluid flow to said pit until the flow thereto is free of drilling fluid and other materials.

8. Method for testing the condition of well bore formations as set forth in claim 6 which includes, supplying said testing fluid from said source connected in fluid communication with the well bore, circulating said testing fluid through the well bore, directing said testing fluid from the well bore to a storage vessel, and conveying said testing fluid from said storage vessel into the flow of said testing fluid from said source to the well bore.

9. Method for testing the condition of well bore formations as set forth in claim 8 which includes, terminating flow from said source into the well bore after a preselected volume of said testing fluid is established in said storage vessel and circulating through the well bore, conveying said testing fluid from said storage vessel to the well bore and back to said storage vessel to establish a closed circulating system, and monitoring the volume of said testing fluid in said storage vessel as said testing fluid circulates through the well bore to determine a change in the volume of said testing fluid therein by the flow of fluid into and out of the formations surrounding the well bore.

10. Method for testing the condition of well bore formations as set forth in claim 6 which includes, introducing said testing fluid consisting of a salt water solution or other suitable liquid from said source into the well bore, flushing the drilling mud and other materials from the well bore by the circulation of said salt water solution through the well bore, and maintaining a hydrostatic head within the well bore by said testing fluid greater than the bottom pressure of the well bore to prevent a blowout condition during the testing of the well bore formation.

11. Method for testing the condition of well bore formations in a closed system for cementing a casing in the well bore comprising, introducing a testing fluid having a preselected density from a source into the well bore, circulating said fluid through the well bore, displacing drilling fluid and other materials from the well bore by the flow of said testing fluid therethrough, conveying said testing fluid and the drilling fluid and other materials from the well bore, monitoring a sample of the flow from the well bore for the presence of gas emitted from the formations surrounding the well bore, maintaining a circulating flow of a known volume of said testing fluid into and out of the well, and monitoring the flow of said testing fluid through the well bore to determine a change in the volume of said testing fluid therein by the flow of fluid into and out of the formations surrounding the well bore.

* * * * *